United States Patent [19]

Dean

[11] 4,022,670

[45] May 10, 1977

[54] PROCESS FOR PREPARATION OF LITHOGRAPHIC PRINTING PLATES

[75] Inventor: Sheldon W. Dean, Allentown, Pa.

[73] Assignee: Swiss Aluminium Ltd., Chippis, Switzerland

[22] Filed: July 16, 1975

[21] Appl. No.: 596,307

[52] U.S. Cl. ..... 204/38 A; 204/58

[51] Int. Cl.[2] ..... C25D 11/06; C25D 11/08; C25D 11/10; C25D 11/18

[58] Field of Search ..... 204/58, 38 A, 38 E

[56] References Cited

UNITED STATES PATENTS

| | | | |
|---|---|---|---|
| 3,031,387 | 4/1962 | Deal | 204/58 |
| 3,227,639 | 1/1966 | Kampert | 204/58 |
| 3,328,274 | 6/1967 | Bushey et al. | 204/58 |
| 3,594,289 | 7/1971 | Watkinson | 204/38 A |
| 3,804,731 | 9/1974 | Yanagida et al. | 204/58 |
| 3,881,998 | 5/1975 | Miyosawa | 204/58 |

*Primary Examiner*—T. M. Tufariello
*Attorney, Agent, or Firm*—Robert A. Dawson; Robert H. Bachman

[57] ABSTRACT

Lithographic printing plates of aluminum or aluminum alloys are provided with an anodized surface layer, to which a photosensitive layer may be directly applied, which displays excellent adhesion and durability in use. For this purpose, anodization is carried out with an aqueous solution containing a polybasic mineral acid such as sulfuric and a higher concentration of a polybasic aromatic sulfonic acid containing at least one additional nuclear acidic substituent, preferably two, selected from the group consisting of a carboxylic acid group and a phenolic hydroxyl group.

7 Claims, No Drawings

PROCESS FOR PREPARATION OF LITHOGRAPHIC PRINTING PLATES

BACKGROUND OF THE INVENTION

This invention relates to the preparation of lithographic sheets or plates of aluminum or aluminum alloys, particularly to an improved anodization process which enables the production of products displaying superior performance and, at the same time, the simplification of the operation through the elimination of treatment steps, which heretofore were considered essential or desirable.

It has been customary in known processes to provide an anodizing step, following the roughening of the plate surface by a suitable mechanical, chemical, or electrolytic treatment. However, it has been considered necessary or desirable in the past, following the anodization step, to apply a sealing or other supplementary treatment, as with an aqueous silicate or dichromate solution, to provide a suitable surface for the proper reception and adequate adhesion of the subsequently applied light-sensitive plate coating layer. This layer may contain any of a large variety of known light-sensitive compounds, such as various diazo or other nitrogen-containing organic compounds, which react to be converted to water-soluble oleophilic image areas after being irradiated with light transmitted through a negative and subsequent development. After the removal of the unexposed non-image areas of the plate surface, such areas are hydrophilic and only the image areas are receptive to the lithographic printing inks, thus enabling the reproduction of the desired printed images. That is, only the oleophilic image areas of the plate are receptive to the printing ink, and the resulting ink image may readily be transferred to a suitable roller, and then printed in its final form.

Such a sequence of essential steps inevitably imposes severe requirements for durability and for strong adhesion of the printing layer to the lithographic plate in order to enable the obtainment of excellent printed reproductions in very large numbers with the use of each plate. While various proposals have been made to effect improvements of such nature, they have not been sufficiently effective and most have increased the complexity of treatment, and therefore the cost, to an undue extent.

SUMMARY OF THE INVENTION

The present invention provides a significant improvement in the anodization step, whereby the grained aluminum plate is anodized with the use of an electrolytic solution having a composition adapted to result in a lithographic plate of satisfactory durability and adhesion properties. Such anodizing solution must include an essential proportion in its electrolyte content of an aromatic polybasic acid containing a sulfonic acid group, particularly an aromatic sulfonic acid containing at least one carboxyl or nuclear hydroxyl group, such as sulfobenzonic acid or a sulfotoluic acid or an isomeric mixture thereof. Preferably, the aromatic sulfonic acid constituent of the anodizing solution contains two carboxyl groups or a carboxyl and a nuclear hydroxyl group, such as a sulfophthalic acid, sulfosalicylic acid, sulfohydroxytoluic acid, or like aromatic sulfonic acids, or isomeric mixtures thereof. The anodizing solution also contains a lower concentration of a polybasic mineral acid, such as phosphoric or sulfuric acid or mixtures thereof, preferably sulfuric acid. The time, temperature, and electrical conditions are controlled to yield an anodized coating over the aluminum surface of desired porosity and thickness, so that the resulting combination of durability and adhesion is obtained within an optimum range.

Such provision has been found to accomplish readily the objectives of the invention of producing a lithographic sheet having an anodized surface displaying superior affinity for the photosensitive coating, combined with outstanding durability in use. Furthermore, such lithographic sheet is prepared by an uncomplicated procedure which is readily controlled.

DESCRIPTION OF THE PREFERRED EMBODIMENTS

In accordance with this invention, an anodized layer of desired adhesion and durability properties is produced by the provision of an anodizing solution containing as principal ingredient an aromatic polybasic acid containing a sulfonic acid group, particularly an aromatic sulfonic acid containing at least one additional nuclear acid substituent selected from the group consisting of a carboxylic acid and a phenolic hydroxyl, and preferably two such additional groups. Mixtures of such acids may be used advantageously, particularly isomeric mixtures thereof. The sulfophthalic acids, and aromatic hydroxy carboxylic acids, such as 5-sulfosalicylic acids, are especially effective. Corresponding sulfo-acid isomers, or mixtures thereof, such as the sulfo-isophthalic acids and the sulfo-terephthalic acids may likewise be employed. Similarly, the sulfo-hydroxy toluic acids are effective for the purpose. These sulfo-acids are generally characterized by high solubility in water and may be used at concentrations of 10 to 250 grams per liter of solution, generally at about 50 to 150 grams per liter.

The anodizing solution must also have a small but effective content of polybasic mineral acid, preferably sulfuric acid, usually within the range of 1 to 25 grams per liter.

The anodizing is preferably conducted at room temperature or within 5° C. thereof, but may at times be carried out at lower or higher temperatures within the range of 10° to 80° C. Anodization is carried out under controlled conditions for a time of 1 to 30 minutes, at a voltage of 20 to 150 volts, preferably at 25 to 40 volts, and at a current density of 5 to 100 amperes, preferably 10 to 40 amperes, per square foot (asf). The current and time of treatment are generally controlled to provide 10 to 40 ampere-minutes per square foot.

The present invention and improvements resulting therefrom will be more readily understood from the following illustrative examples, including comparative tests.

EXAMPLE I

Lithographic sheet, eleven by sixteen inches in size, made of aluminum 3003 Alloy, was given the following successive treatments:

Cleaning

1. Non-etch clean for 5 minutes in an alkaline detergent solution, at about 50° C.
2. Rinse thoroughly in flowing tap water.
3. Remove oxide film with nitric acid solution, using concentrated nitric acid diluted with an equal volume of water, for 1 minute, at room temperature.

4. Rinse thoroughly in flowing tap water.

Etching

5. Etch in 60 grams per liter solution of ammonium bifluoride solution in distilled water at 55° C. for 1 minute.

6. Rinse thoroughly in tap water.

7. Desmut in nitric acid (step 3 above).

8. Rinse thoroughly in tap water.

Anodizing

9. Anodize in a solution of 100 grams per liter of 4-sulfophthalic acid and 5 grams per liter sulfuric acid at 20° C., at current density of 18 amperes per square foot for 1 minute.

10. Drain, rinse thoroughly in distilled or demineralized water.

The cell and pore size in the anodic layer were about 1050 and 350 respectively.

The anodized sheet surface was then uniformly coated with a photosensitive layer of the diazo type by applying a 2% aqueous solution of such material, such as "Fotogold MN30" (manufactured by S. D. Warren Co.). to a level thickness, and drying. The sheet was then exposed to carbon arc light transmitted through a photographic negative in contact with the sheet surface. The sensitized sheet surface was then subjected to treatment with a conventional diazo developer. The resulting developed image was firmly adherent and was capable of producing faithful printed reproductions characteristics by excellence and sharpness of detail throughout repeated runs of many thousands of prints.

EXAMPLE II

For direct comparison with the excellent results attained in accordance with Example I, an identical litho sheet of the same aluminum alloys was prepared by treatment identical with that of Example I, except for the anodizing step. In this example, the anodization was accomplished by means of an aqueous solution of 165 grams per liter of sulfuric acid at 20° c. for 1 minute at a current density of 18 amperes per square foot. The anodic layer in this case displayed cell and pore size of 425 A and 140 A, respectively.

The sheet was sensitized, exposed, and developed, in the identical manner as described in Example I. However, in sharp contrast to the excellent adhesion and durability attained in Example I, extensive areas distributed throughout the image produced on the sheet surface in this example displayed poor adhesion and wiped off during the development step, and the sheet was useless for the intended purpose.

EXAMPLE III

Litho sheets of aluminum alloy 1100 were cleaned by immersion for 5 minutes in a detergent solution at 50° to 55° C., drained and rinsed thoroughly with tap water.

The sheets were then treated for removal of the oxide surface for 1 minute at room temperature in a solution formed by diluting concentrated nitric acid with an equal volume of water, and rinsed with tap water.

Then, the sheets were chemically etched by a 1 minute immersion in an aqueous alkaline solution containing 55 grams per liter of NaOH and 8 grams per liter of dissolved aluminum at 50° to 55° C. The etched sheets were rinsed in tap water, desmutted by treatment for 1 minute at room temperature in concentrated nitric acid diluted with an equal volume of water and rinsed in tap water.

An anodizing solution was prepared containing 100 grams per liter of 4-sulfophthalic acid, 6 grams per liter of sulfuric acid, and 1 gram per liter of dissolved aluminum. The cleaned and etched aluminum sheets were anodized in the above solution at 20° C. for 1 minute, at a current density of 18 asf at 38 volts, resulting in an adherent porous anodic coating, having a specific coating weight of 0.097 mg. per square centimeter, and a pore and cell sizes of 380 A and 1100 A, respectively.

EXAMPLE IV

Litho sheet identical to that of the preceding example and pretreated by the same sequence of preparatory steps was anodized at 20° C. for 1 minute at 18 asf in an aqueous solution containing 65 grams per liter of 5-sulfosalicylic acid and 5 grams per liter of sulfuric acid. An adherent porous anodic coating was formed having a specific coating weight of 0.091 mg. per square centimeter.

The anodized sheets prepared in accordance with Examples III and IV were tested in a Taber Abraser for wear and scratch resistance, and yielded values substantiating high resistance to such factors.

When provided with a photosensitive surface and subsequently exposed to radiation from a carbon arc light through a test negative, and the image developed, as described in Example I, lithographic plates displaying excellent adhesion and durability are produced, the results being similar to those described in Example I.

Although the mechanism of the strikingly beneficial effects eventuating from the above-described use of aromatic sulfopolybasic acid in the anodizing solution in not known with certainty, it appears quite likely that these acidic compounds are retained in the anodic coating through the operation of attractive forces between substituent groups and that similar forces exist in relation to substituent groups present in the photosensitized layer. However, regardless of the specific mechanism involved, the essential feature is the resulting improvement in adhesion and durability. This is especially advantageous in that such result enables the elimination of the additional treatment steps which would otherwise be required.

Generally, the anodizing treatment selected for a given application is preferably one carried out at about ambient temperatures, thereby avoiding the added expense and inconvenience of providing the additional heating or cooling means.

Likewise, the electrolyte composition and concentration is preferably and readily adjusted to attain optimum effectiveness of the particular photolithographic operation involved.

It will be understood that the invention may be embodied in modified forms without departing from the principles thereof. The above specific examples are therefore to be considered as illustrative of the invention. Modifications thereof which come within the scope and spirit of the appended claims are accordingly intended to be embraced therein.

What is claimed is:

1. A process of preparing lithographic aluminum sheet having a grained surface, comprising the steps of:

a. anodizing said grained sheet in an aqueous solution containing up to 250 grams per liter of a polybasic aromatic sulfonic acid having at least one nuclear acidic constituent selected from the group consisting of a carboxylic acid and a phenolic hydroxyl, and a lesser concentration of a polybasic mineral acid, said anodizing solution being maintained at a temperature of 10° to 80° C and effecting the anodization within 1 to 30 minutes, at a potential of 20 to 150 volts and a current density of 5 to 100 amperes per square foot, whereby to produce a porous anodic oxide surface coating on said grained sheet;

b. coating the anodized sheet with a photosensitive layer;

c. exposing said photosensitive layer to light through a stencil or a photographic negative to develop hardened areas on said photosensitive layer at points which the light passing through said stencil or negative contacts said layer; and d. washing said sensitized layer to remove those areas not contacted by light, leaving the light-hardened areas as oelophilic receptors for subsequently applied oleaginous printing ink.

2. The process of claim 1 wherein the said anodizing solution contains 50 to 150 grams per liter of the said polybasic aromatic sulfonic acid and 1 to 25 grams per liter of sulfuric acid.

3. The process of claim 1 wherein the anodization is effected at about room temperature at 25 to 40 volts and a current density of 10 to 40 amperes per square foot.

4. The process of claim 1 wherein the said polybasic sulfonic acid is a sulfo-phthalic acid.

5. The process of claim 1 wherein the said polybasic sulfonic acid is a sulfo-salicylic acid.

6. The process of claim 1 wherein the said anodizing solution contains a mixture of polybasic aromatic sulfonic acids.

7. The process of claim 1 wherein the resulting anodic oxide layer has cell and pore size of about 1050 and 350 A, respectively.

* * * * *